United States Patent [19]

Brown

[11] 3,970,212

[45] July 20, 1976

[54] EASY OPENING ECOLOGY END WITH RETAINED TEAR STRIPS

[75] Inventor: Omar L. Brown, Dayton, Ohio

[73] Assignee: Ermal C. Fraze, Dayton, Ohio

[22] Filed: June 10, 1974

[21] Appl. No.: 477,678

[52] U.S. Cl. ..... 220/269; 220/271; 220/273; 220/367

[51] Int. Cl.[2] ..... B65D 17/20

[58] Field of Search ..... 220/90.6, 268, 269, 220/270, 271, 273, 367, 272

[56] References Cited

UNITED STATES PATENTS

| | | | |
|---|---|---|---|
| 3,221,924 | 12/1965 | Harvey et al. | 220/269 X |
| 3,313,446 | 4/1967 | Harvey | 220/271 |
| 3,325,043 | 6/1967 | Henchert et al. | 220/270 |
| 3,334,778 | 8/1967 | Saunders | 220/270 X |
| 3,442,416 | 5/1969 | Nicholson | 220/269 |
| 3,448,887 | 6/1969 | Geiger | 220/273 |
| 3,704,805 | 12/1972 | Sheafe | 220/273 |
| 3,734,338 | 5/1973 | Schubert | 220/269 |
| 3,744,667 | 7/1973 | Fraze et al. | 220/269 |
| 3,795,342 | 3/1974 | Ashton | 220/269 |
| 3,796,344 | 3/1974 | DePhillips et al. | 220/269 |

*Primary Examiner*—William Price
*Assistant Examiner*—Stephen Marcus
*Attorney, Agent, or Firm*—George F. Smyth

[57] ABSTRACT

An easy opening ecology end having retained vent and pour tear strips is formed by an end wall having two lines of weaknesses. One line of weakness defines a vent opening while the other line of weakness defines a pour opening. Attached to each of the tear strips is a tab including a body member and end portions, the tab being attached to the respective tear strips by rivets. Each line of weakness terminates in a reversing curl to prevent continued complete separation of the tear strip. The lines of weakness, the reversing curves and the relative position and radii of the reversing curves cooperate to form a hinge line about which the ruptured tear strips are folded such that the tear strips are retained and folded back against the end wall. A protective bead protects the user against laceration, while the panel defining the pour opening is such that with the panel folded against the end wall, a protrusion is formed preventing the user from contacting the exposed sharp edge of metal of the retained tear strip. The protrusion, in the unruptured form of the container is a depression which functions to maintain the adjacent score line in compression while at the same time providing rigidity.

20 Claims, 10 Drawing Figures

EASY OPENING ECOLOGY END WITH RETAINED TEAR STRIPS

BACKGROUND OF THE INVENTION

Figure 1:
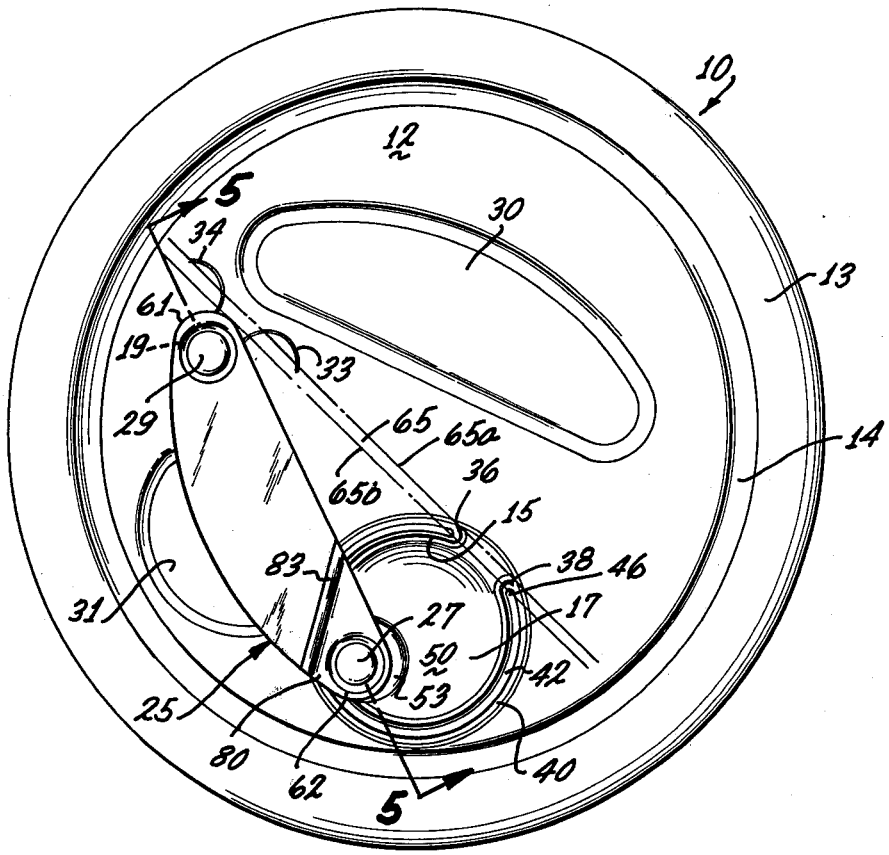

This invention relates to easy opening cans and, more specifically, to an improved easy opening container wall including inseparable tear strips, each defined by a separate score line, wherein the tear strips may be opened with a single retained tab member, and wherein protective means are incorporated in order to reduce the incidence of laceration.

The ready acceptance of easy opening containers has resulted in extended use of this type of container for a substantial number of canned products, especially beverages such as beer, soft drinks and the like, as well as other products which are non-carbonated. This type of container is characterized by a lever or tab permanently joined to a tear strip, the latter normally bein separable from the can top to provide a pouring spout, in the case of beverages. In the form heretofore used, the tab or top is ruptured along a continuous score line and the pull tab and tear strip is normally removed and discarded.

The convenience of easy opening cans has created problems because of the unfortunate and indiscriminate disposal of the severed portion of the can top. For example, beach and picnic areas have had an accumulation of litter in the form of tabs and tear strips which have been removed from easy opening cans. These discarded tabs and tear strips are quite difficult to clean up because they are small and thus pass through the tines of a rake. Being made normally of aluminum, they cannot be collected by magnetic means. Nonetheless, this type of can is widely used and it is definitely advantageous to provide a solution to the problem of littering while still providing to the public the convenience of easy opening containers.

The numerous advantages incident to the use of easy opening cans are significantly enhanced if a container end is provided including an inseparable tear strip and which is relatively safe to use in the sense that the incidence of lacerations are reduced. As will be appreciated, where a tear strip is not separable from the end wall, precautions must be taken to prevent laceration by the retained tear strip or by the exposed edge of metal formed upon opening of the container. This is particularly true with respect to small children who exhibit a tendency to place their fingers down into the pour opening of an easy opening container.

The packaging industry is generally aware of the problem of indiscriminate littering of separable tabs and tear strips as well as the potential problem of laceration.

Accordingly, it is definitely advantageous to provide an easy opening end wall structure with a retained tear strip system in that there are no detachable components which may be thrown away as litter. In such an end structure, it is desirable to retain, to the extent possible, the opening action, which is in the form of lifting to bring about rupture of the score lines, since the public is accustomed to this type of opening action in an easy opening end wall.

It is also advantageous to provide an easy opening end structure having the advantages previously noted that is a conversion and interchangeable with present tooling used by the industry in the sense that the basic container dimensions need not be altered in order to accommodate the improved end. An additional factor is that the end should provide normal performance for the variety of products packaged in convenient easy opening end type containers, for example, an end structure which is capable of withstanding the normal pressures utilized in the beer and beverage industry, and particularly those products packaged under pressure or which develop pressure during their packaging, for example, pasteurization of certain beer type products.

DESCRIPTION OF THE PRIOR ART

It is known to use a noncontinuous score line such that the tear strip is firmly attached to the container. Such a structure is shown in U.S. Pat. No. 3,327,891.

An improvement in the structure described in the above-identified U.S. Patent is described in U.S. application Ser. No. 103,255, filed Dec. 31, 1970, as well as U.S. application Ser. No. 346,712, filed Mar. 30, 1973, each assigned to the same assignee as this application.

Recently, beverage and beer containers have appeared in commercial use which include a push type opening which is ruptured by pushing downwardly upon a panel and folding it into the container. This type of structure is objectionable principally because of the laceration problem since it is necessary for the user to place his finger through the pour opening during the opening operation.

SUMMARY OF THE INVENTION

The present invention relates to an easy opening container wall structure which offers several distinct advantages not heretofore found in prior devices. The container end wall of the present invention includes a retained tear strip structure in that the tear strip cannot be discarded once the pour opening has been formed. Moreover, recognizing the need to provide an easy opening container which vents properly during the opening sequence, the end wall of the present invention includes a separate vent opening, the pour opening and the vent opening being provided in a single opening sequence which follows generally the opening operation heretofore used with the more conventional easy opening container ends.

More specifically, the easy opening wall of the present invention includes an end wall and a first line of weakness in the end wall which defines a tear portion partially removable from the end wall to form a pour opening. Also provided in the end wall is a second line of weakness, spaced from the first line of weakness, and defining a vent tear portion partially removable from the end wall to form a vent opening. A tab structure is attached to each of the tear portions, preferably by an integrally formed rivet, and is used to rupture the lines of weakness and is likewise retained on the end wall after the opening sequence.

Each line of weakness includes an associated means for preventing complete removal of the ruptured tear strips. Accordingly, as the tab is manipulated to rupture the score lines, inseparable tear strips are formed which are joined to the tab and the tab and tear strips can be folded back against the end walls of the container, out of the way of the user, but retained on the container end wall.

Figure 2:
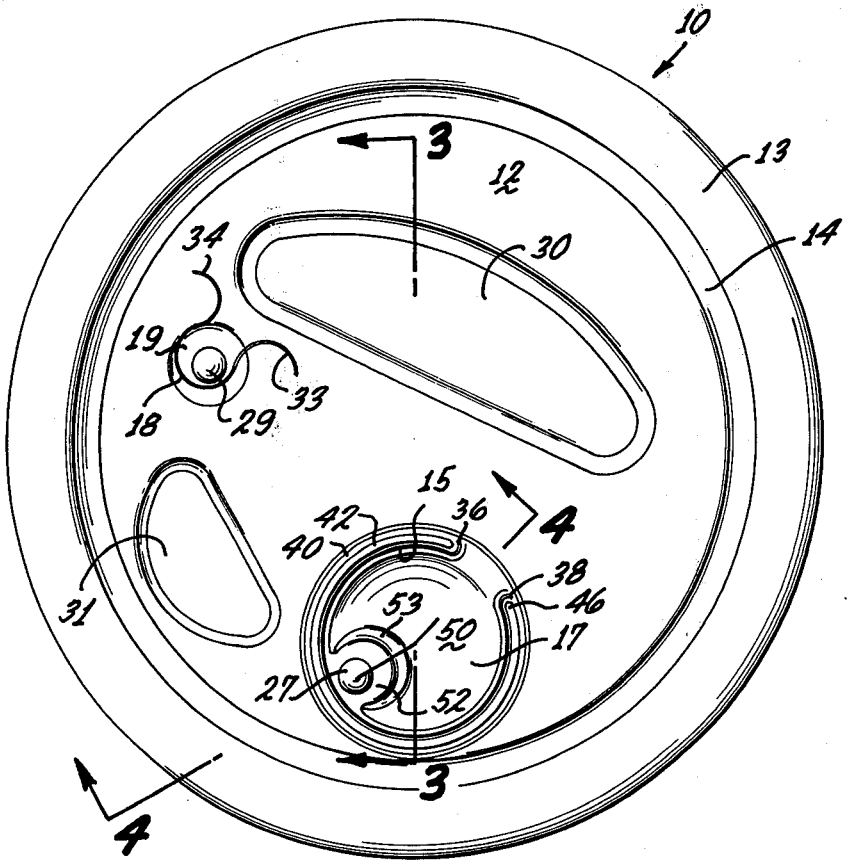

Another feature of the present invention is the provision of protective means associated with the tear strip which forms the pour opening and the residual metal which surrounds the pour opening. In one form, a raised protective bead is formed adjacent to the score pour opening includes a generally annular raised flat 40, the flat in turn including a protective bead 42 which circumscribes that portion of the end wall which defines the pour opening. As illustrated, the score line 15 is located on the raised flat 40 and closely adjacent to the protective bead 42. Thus, as the score line 15 is ruptured, the amount of laterally extending residual cutting edge is reduced. Moreover, the presence of the protective bead 42 tends to inhibit contact between the free edge and the user's finger. As shown in FIG. 2, the ends 46 of the protective bead 42 terminate a short distance from the reversing curves 36 and 38. Since the vent opening normally does not create any problems with respect to laceration due to its relatively small opening, it is not necessary to provide the vent opening or the vent tear strip with any form of protective bead or other form of protective device.

In order to protect the user from laceration by the portion of the end wall panel which constitutes the pour opening tear strip 17, the latter is provided with a downwardly extending depression 50, which in addition to forming a protective means forms several other functions as will be described.

Figure 3:
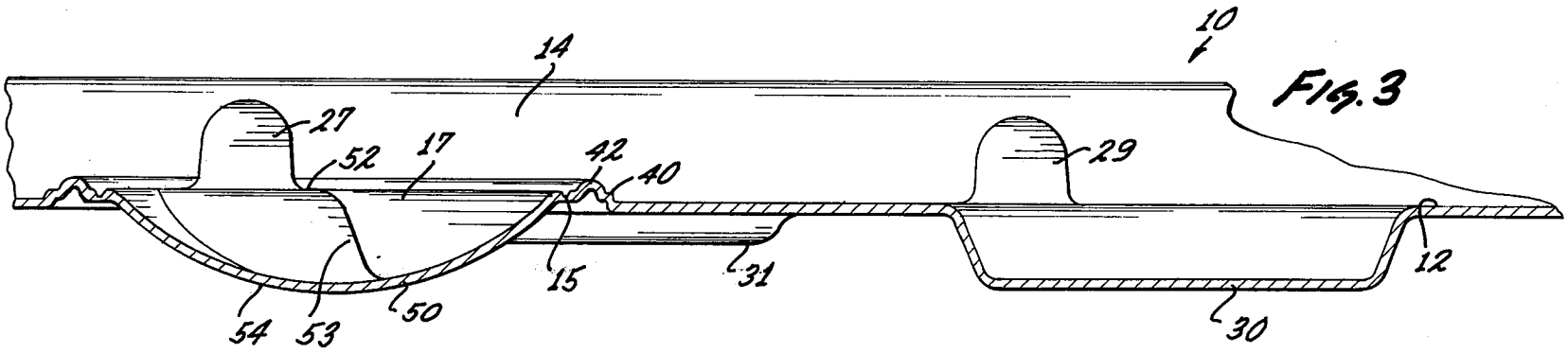
Figure 4:
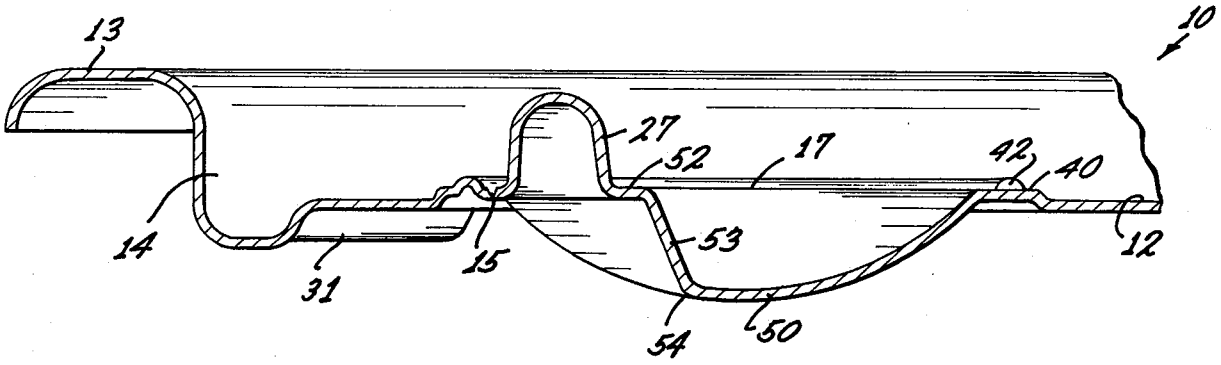

As illustrated in FIGS. 2 through 5, rivet 27 is positioned in a rivet well 52 formed in panel 17, the rivet well being generally planar and at approximately the same vertical level as the raised flat 40. Cooperating with the rivet well is a generally arcuate, sloping wall 53 whose maximum relative dimension is illustrated in FIG. 4 and which generally decreases in dimension to the right and to the left of the section line 4—4 of FIG. 2. The sloping wall 53 operates to permit the rivet to be placed in a flat plane while likewise permitting the downward depression 50 to be formed into the tear panel 17 which forms the pour opening.

One function of the downward depression 50 is to maintain the associated score line 15 in compression, especially in those instances in which the contents in the container are under some pressure. Referring to FIG. 3, for example, pressure on the underside 54 of the depression 50 operates to maintain the score line 15 in compression. In this way, score line integrity is enhanced, particularly in those instances in which the contents of the container are under considerable pressure as may be the case with certain types of carbonated beverages. Score line integrity is also important in those instances in which the processing involves the use of a pasteurization step which creates substantial pressures during the pasteurization operation. The downward depression 50, in that particular instance, also acts to prevent considerable bulging of the container end in the sense that the container end takes a permanent set in the domed configuration.

Figure 6:
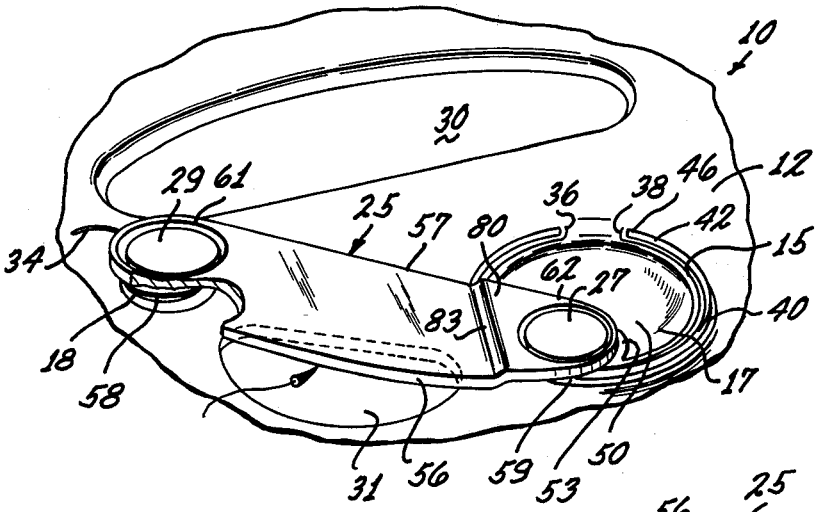
Figure 7:
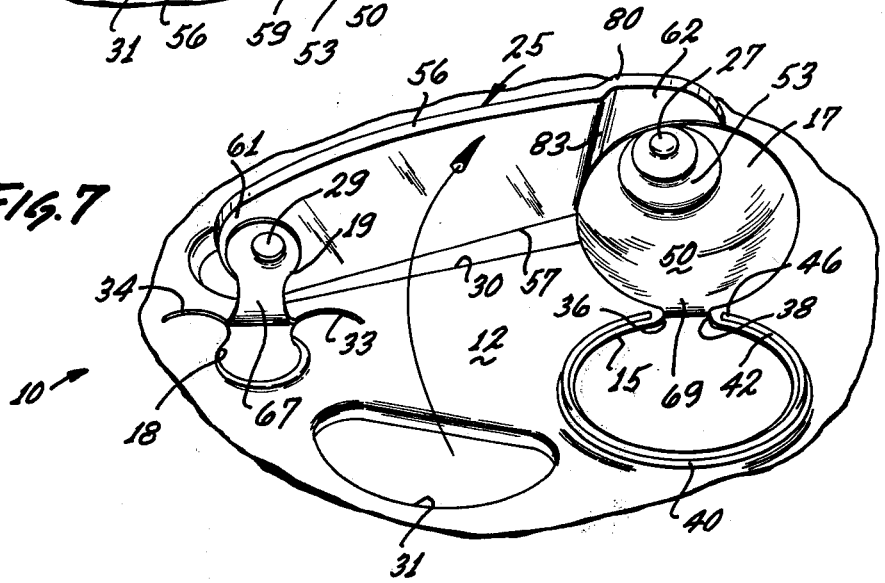
Figure 8:
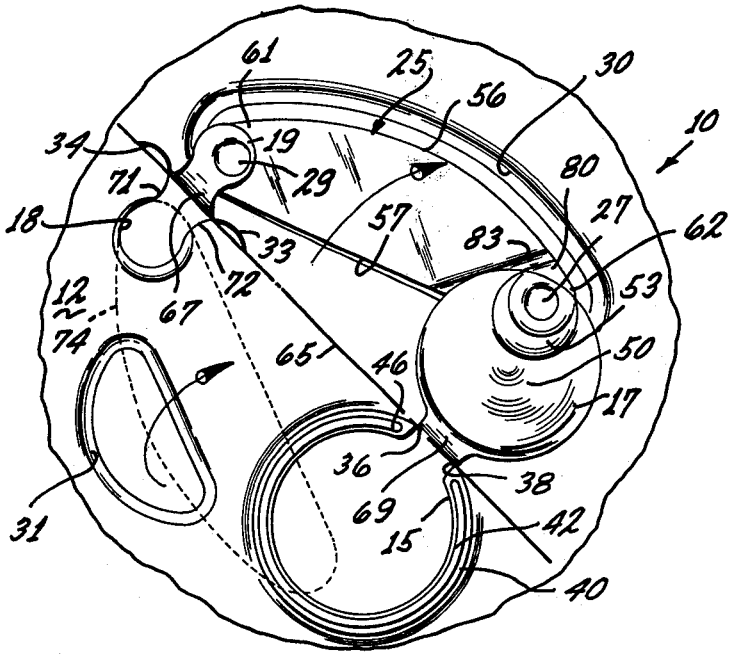

Referring to FIGS. 6 through 8 wherein like reference numerals have been applied, the opening sequence of the container end wall may be understood, as well as the additional functions performed by the protective depression 50. As illustrated in FIG. 6, the user inserts his finger between the tab 25 and the finger well 31 and lifts the tab 25 in an upward direction, following generally the operation used in opening a beverage container having a ring type pull tab. During the initial movement of the tab 25, the score lines 18 and 15 are stressed, preferably such that score line 18 begins to rupture immediately prior to the start of rupture of score line 15. As long as the vent score line 18 starts to rupture immediately prior to, or simultaneously with the rupture of score line 15, the venting action sought to be achieved in accordance with the present invention is obtained. Thus, the initial manipulation of the tab is effectively a rotating action in the sense that the end 56 of the tab is lifted upwardly and the edge portion 57 is rotated downwardly in stressing the score lines 18 and 15 in the portions generally designated 58 and 59, respectively. Since the single tab 25 is attached at its ends 61 and 62 to rivets 29 and 27, respectively, the manipulation of the single tab element is effective simultaneously to open both score lines either simultaneously or with the score line of the vent opening being initially popped slightly ahead of the score line for the pour opening.

As the user continues to manipulate the tab 25 by a rotating lifting action towards a vertical plane, the score lines 15 and 18 are ruptured to the point of the reversing curves associated therewith which, as earlier indicated, operate to prevent complete severance of the vent tear strip and the pour strip from the end wall. Thus, a fold zone 65 exists, as illustrated in FIG. 1 between lines **65*a* and 65*b* which effectively forms a hinge line for the vent panel and pour panel resulting from severance of the score lines 15 and 18**.

As illustrated in FIG. 1, the center point from rivet 29 to the fold zone is substantially less than the distance from the center of rivet 27 to the fold zone 65. Accordingly, to effect complete severance of the score lines while providing the retained tear strips, it is necessary that the end 62 of the tab 25 move through a greater arcuate distance vertically above the end wall than the end 61.

Referring to FIG. 7, the general vertical orientation of the tab 25 attached to the tear strips 67 and 69 is illustrated, as well as the difference in vertical heighth above the end wall of the ends 62 and 61 of the tab 25.

In the type of opening action described, it is important that the tear strip 69 be folded about the fold zone 65 rather than midway or part way through the panel. Accordingly, another function of the depression 50 is to provide structural integrity to the tear strip 69 thereby assuring that it folds along the fold zone 65 rather than folding in the middle. Since the length of tear strip 67 is relatively short, no reinforcement is needed since the legs 71 and 72 of the score line are relatively short from the center point of the rivet to the reversing curves 33 and 34.

Once the tab has been elevated to the vertical position with the tear strips oriented generally in a vertical position, it is possible for the user to continue to rotate the tab around the fold zone 65 and to push the tab 25 into the tab receiving well 30. Such a relative position is indicated in FIG. 8 with the tab in its initial position indicated by the dotted lines 74.

In the opened condition, as illustrated in FIG. 8, with the tab 25 pushed into the tab receiving pocket 30 and with the tear strips folded about the fold zone 65, depression 50 now appears as a protrusion rising above the folded pour strip 69. The protrusion 50 which extends above the surface of the end panel protects the user from contacting the exposed edges on the tear strip 69 since the panel is folded against the end wall and in contact therewith by virtue of the fact that the depression 30 receives the tab. Thus, the protective depression, now operating as a raised projection, assists materially in preventing the user's nose or fingers from contacting the exposed edge of metal along the periphery of the panel 69.

Figure 5:
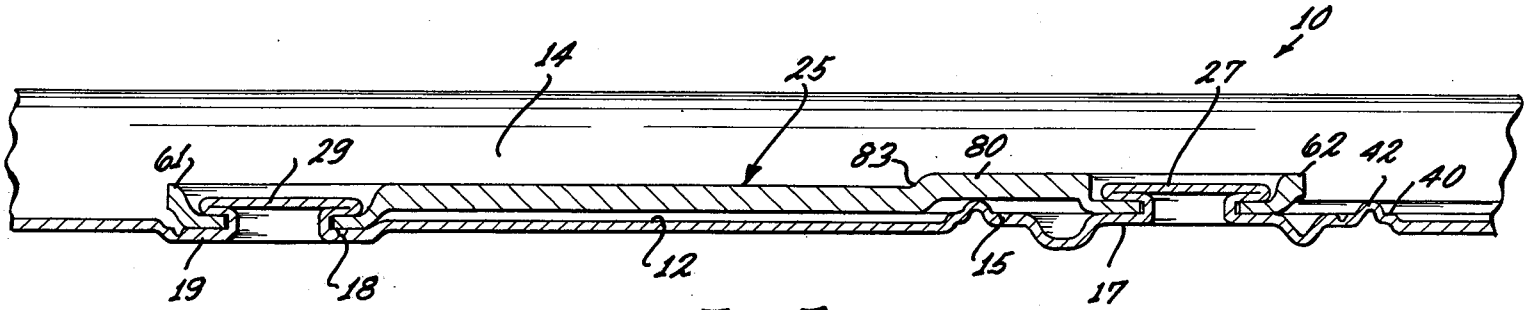

As seen in FIG. 5, the rivet 27 is somewhat vertically above the rivet 29 and in order for the tab 25 to lay flat against the end panel of the container end wall, it includes a vertically raised section 80 at the end 62 thereof to which the rivet 27 is attached. The other end 61 is attached to rivet 29, with the portion 80 being raised along a generally angularly disposed line 83 as seen in FIG. 1.

Figure 9:
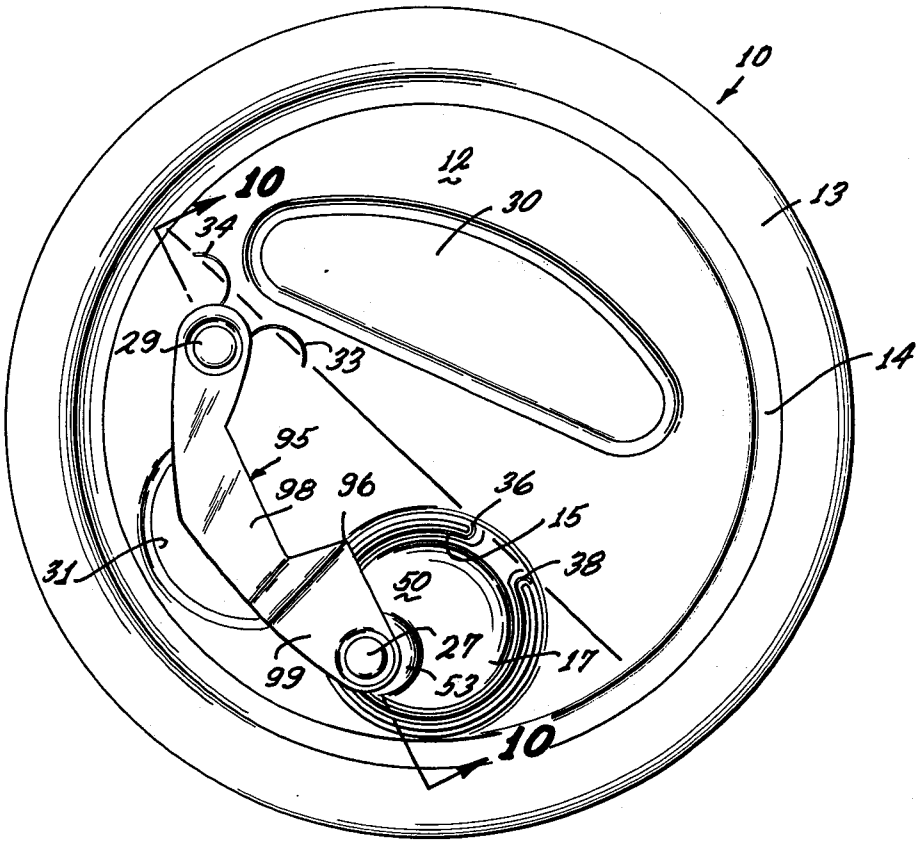
Figure 10:
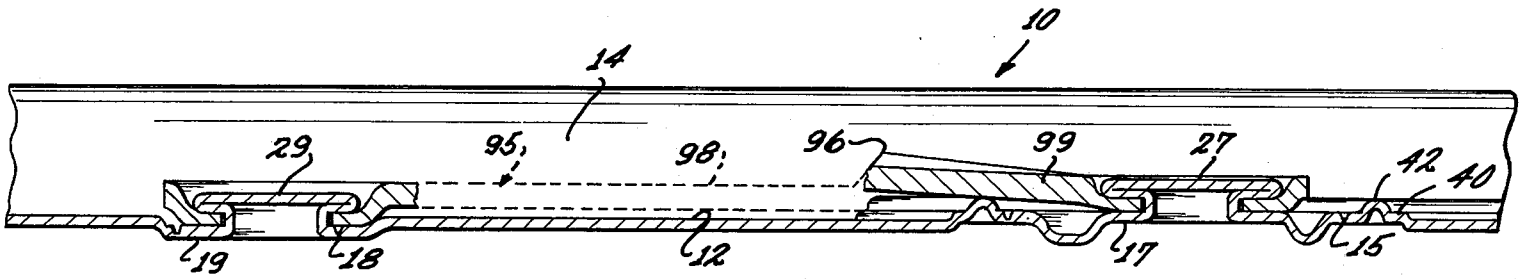

While the above structure operates effectively and in the manner described, it will be apparent that modifications may be made. For example, referring to FIGS. 9 and 10 wherein the same reference numerals have been used where applicable, the tab 95 is attached to the rivets 29 and 27, the tab including a fold shoulder 96 at the junction between the body portion 98 and the end 99 attached to the rivet 27. The fold shoulder operates to contact the end panel of the container during the operation of the tab thereby permitting somewhat easier rupturing of the score line 15 in the tear panel which forms the pour opening.

In all other respects, the end panel is essentially the same as that previously described.

The end structure of the present invention may be easily manufactured in a series of operations on an end blank. For example, that tab well and finger well are first formed, the depression and bead are then formed, the scoring then placed, and finally the tab is staked. It is understood that the rivet button may be formed in the bubble and button stages or what is called a single hit rivet.

While the pour opening has been shown as generally circular in shape, other shapes may be used because of the presence of a vent opening separate from the pour opening which substantially improves the pouring characteristics of a container with an end wall as herein described.

It is to be understood that depression 50 may be a protrusion if only a stiffening means is needed to prevent the pour panel from folding during an opening sequence. Where protection and increased score integrity are also desired, the depression will achieve all three functions, as described.

One of the definite practical advantages of the present invention is the fact that venting is easily accomplished by a separate vent opening located in a portion of the end panel other than where the pour opening is located. Also, since the tab is rigidly held by rivets to the tear panels which are inseparable from the end wall and folded into the tab receiving recess 30 after opened, there is little tendency to remove the tab from the tear strips to which it is attached. Since the entire opened end of the end wall is folded back, it is, in a sense, out of the user's way and there is no need for any further manipulation of the tab or the tear strips during the dispensing of whatever material is within the container.

Another practical advantage of the end structure of the present invention is the fact that the pouring characteristics of the container are enhanced considerably by the use of a separate vent opening. As shown in the drawings, the pour opening is located closely adjacent to the chuck wall which places the vent opening in the upper quadrant of the container during a normal pouring operation. This permits air to come in through the top of the container while liquid is being dispensed from the lower end, in a pouring operation. It is for this reason, that the rivets are located on a straight line which defines a cord with respect to the end wall, the cord being so located as to permit the tab and retained but fractured tear strips to be folded back into the end wall and out of the way of the pour opening and the vent opening.

Thus, the container end structure of the present invention offers several advantages over the prior art structure including a retained tear strip structure and more importantly a retained tab structure which is not easily removed from the tear strips. Means are provided to protect the user against laceration, and there is no need for the user to insert a finger into the pour opening. Even so, if this is done, there is a measure of protection provided by the protective beads which surround the major portion of the pour opening, as described, and thus protection is afforded against laceration. Accordingly, the combination of a retained tear strip, attractive from an ecology standpoint, with the protective features as described, and the highly desirable pouring characteristics all offer a combination of advantages which are sought after in the design of container end structures.

It will be apparent to those skilled in the art that there are several features of the present invention. Thus, many modifications and alterations of the disclosed and described embodiments may be made as will be apparent to those skilled in the art, without departing from the scope of the invention as defined in the following claims.

What is claimed is:

1. An easy opening container wall comprising:

means forming an end wall, a line of weakness in said end wall defining a tear portion at least partly removable from said end wall to form a pour opening, a second line of weakness spaced from said line of weakness and defining a vent strip forming a vent opening smaller than the pour opening in a portion of said end wall other than in said tear portion, tab means having end portions for attachment to each of said tear portion and said vent strip for rupturing said lines of weakness, means attaching said tab means to each of said tear portion and said vent strip whereby manipulation of said tab means ruptures both score lines and forms an exposed edge on said tear portion and the portion of said end wall from which said tear portion was removed, each of said first and second line of weakness including means to prevent complete separation of said tear portion and vent strip from said end wall and defining a hinge line whereby the ruptured but retained tear portion and vent strip may be folded against said end wall, one of said end portions of said tab means being closer to said hinge line than the other of said end portions, and protective means provided in each of said tear portion and the end wall from which said tear portion was removed for reducing the possibility of laceration by the user by the exposed edge of said tear portion and the exposed edge of the end wall from which said tear portion was removed.

2. An easy opening container wall as set forth in claim 1 wherein the end portion of said tab means closer to said hinge line is affixed to said vent strip.

3. An easy opening container wall as set forth in claim 2 wherein said tab means includes a fold shoulder which contacts the end panel during an opening sequence.

4. An easy opening container wall as set forth in claim 1 wherein the other of said end portion of said tab means is moved through a greater arcuate distance vertically above the end wall than said one of said end portions during an opening sequence.

5. An easy opening container wall as set forth in claim 1 wherein said protective means on said end wall includes bead means formed radially outwardly of the score line and adjacent thereto for reducing laceration by the exposed edge of the end wall.

6. An easy opening container wall as set forth in claim 1 wherein said protective means formed on said tear strip is a raised section extending above said tear strip when the latter is folded against said end walls.

7. An easy opening container wall comprising:

means forming an end wall, means in said end wall forming a tear portion at least partially removable from said end wall to form a pour opening, means in said end wall spaced from said tear portion forming a vent tear rupture of which forms a vent opening, tab means including a first end attached to said tear portion and a second end attached to vent tear for effecting rupture of said tear portion, means cooperating with each said tear portion for retaining the same in said end wall, means cooperating with said tab means and said tear portions and defining a hinge line whereby the ruptured and retained tear portions may be folded against said end wall, and said first end of said tab means being spaced from said hinge line a distance greater than the spacing between the second end and said hinge line such that the first end of said tab moves through a greater arcuate distance vertically above the end wall than the second end in an opening sequence.

8. An easy opening container wall as set forth in claim 7 further including means cooperating with the line of weakness forming said pour opening for maintaining the latter in compression prior to rupture thereof.

9. An easy opening container wall as set forth in claim 8 wherein rupture of the end wall to form said pour opening forms an exposed edge on said end wall and the portion thereof which is ruptured to form said pour opening, and protective means provided in each of the exposed edge of said end wall and the exposed edge of the ruptured portion for reducing the possibility of laceration.

10. An easy opening container wall as set forth in claim 9 wherein said protective means is associated with the exposed edge of the end wall.

11. An easy opening container wall as set forth in claim 10 wherein said protective means includes raised bead means formed in said end wall and generally surrounding the opening formed by rupture of the score line forming said pour opening.

12. An easy opening container wall as set forth in claim 9 wherein said protective means includes a downwardly extending depression in the portion of the end wall which is ruptured, said depression being operative to maintain the associated score line in compression, and said depression being operative upon folding of said ruptured portion forming said pour opening to form a raised portion operative to reduce laceration by the exposed end of the end wall which is ruptured to form said pour opening.

13. As easy opening container wall as set forth in claim 8 wherein said last named means includes a downwardly extending depression formed in the portion of said end wall which is severed to form the pour opening.

14. An easy opening container wall as set forth in claim 7 wherein the end wall includes means forming a depression on the side of said hinge line opposite vent and tear openings for receiving said tab means as said tear portions are folded against said end wall.

15. An easy opening container wall as set forth in claim 7 wherein said end wall includes means forming a depression located beneath said tab whereby a user may insert a finger between the end wall and tab means for operating the latter in an opening sequence.

16. An easy opening container wall comprising:

means forming an end wall;

a first line of weakness in said end wall defining a panel for forming a pour opening, a second line of weakness in said end wall defining a rupturable panel forming a vent opening smaller in size than said pour opening, means associated with said end wall to effect rupture of said first and second lines of weakness, means affixing said rupturing means to each of said rupturable panels, said rupturable panel which forms said pour opening including stiffening means to prevent bending of said panel during rupture of said first line of weakness, means associated with each line of weakness for retaining the ruptured panel on said end wall whereby the panels may be folded back against said end wall, means forming a hinge line around which each of said panels is foldable, and the dimension from the affixing means for the vent panel opening to the hinge line being less than the dimension from the affixing means of the panel for the pour opening to the hinge line.

17. An easy opening container wall as set forth in claim 16 wherein the tab is positioned on one side of the hinge line prior to opening and is positioned against the end wall on the other side of said hinge line after opening so as to retain the panels against the wall after an opening sequence.

18. An easy opening container wall as set forth in claim 17 wherein said tab includes an end portion which is raised relative to the remainder of said tab, and the end portion of the tab which is raised being affixed to the panel which forms the pour opening.

19. An easy opening container wall as set forth in claim 16 wherein said means to effect rupture of said lines of weakness is a tab member having a body portion and spaced end portions, and said affixing means being integrally formed means interconnecting each panel with a respective end portion of said tab member.

20. An easy opening container wall as set forth in claim 19 wherein said tab member includes a fold shoulder.

* * * * *